US006550572B2

(12) United States Patent
Lin

(10) Patent No.: US 6,550,572 B2
(45) Date of Patent: Apr. 22, 2003

(54) EXHAUST PIPE FOR AN AUTOMOBILE OR A MOTORCYCLE

(76) Inventor: Min-Chyr Lin, No. 90, Pei Hui, Hui Kuei Village, Shui Shang Hsiang, Chiayi Hsien (TW)

( * ) Notice: Subject to any disclaimer, the term of this patent is extended or adjusted under 35 U.S.C. 154(b) by 0 days.

(21) Appl. No.: 09/928,688

(22) Filed: Aug. 14, 2001

(65) Prior Publication Data

US 2003/0034201 A1 Feb. 20, 2003

(51) Int. Cl.[7] ..... F01N 1/10
(52) U.S. Cl. ..... 181/252
(58) Field of Search ..... 181/252, 249, 181/255, 256, 258, 229, 282

(56) References Cited

U.S. PATENT DOCUMENTS 5,602,368 A * 2/1997 Kaneso ..... 181/250
6,138,791 A * 10/2000 Zanzie ..... 181/252
6,385,967 B1 * 5/2002 Chen ..... 181/252
6,394,225 B1 * 5/2002 Yasuda ..... 181/256

* cited by examiner

*Primary Examiner*—Kim Lockett
(74) *Attorney, Agent, or Firm*—Rosenberg, Klein & Lee

(57) ABSTRACT

An exhaust pipe includes an outer pipe and an inner pipe firmly fitted in the outer pipe. An air intake pipe and an outlet pipe having a comparatively small diameter are positioned respectively at two opposite ends of the outer pipe and respectively communicating with the front and the rear end of the inner pipe. Besides, a great number of through holes are bored around the wall of the inner pipe. Then an intermediate pipe having numerous through holes around the wall is fitted around the inner pipe, with a plurality of gaps formed between both the pipes. The muffling cotton is filled in a space between the outer pipe and the intermediate pipe. Thus, the intermediate pipe is easy to assemble, kept secured firmly for a long time and achieving effectual muffling.

4 Claims, 4 Drawing Sheets

EXHAUST PIPE FOR AN AUTOMOBILE OR A MOTORCYCLE

BACKGROUND OF THE INVENTION

This invention relates to an exhaust pipe for an automobile or a motorcycle, particularly to one simple in assembling, possible to keep firm all the time and having good effect of muffling.

A known conventional exhaust pipe, as shown in FIGS. 5 and 6, includes an outer pipe 10 fixedly fitted with an inner pipe 20 inside. An air intake pipe 101 and an air outlet pipe 102 with a comparatively small diameter positioned at two opposite ends of the outer pipe 10 and respectively communicating with the front and the rear ends of the inner pipe 20. Further, the inner pipe 20 has numerous through holes 201 bored around its pipe wall and has its outer circumference wound smoothly by galvanized iron strings 30. Then, muffling cotton 40 is filled in a space between the outer pipe 10 and the galvanized iron wires 30.

In using, exhausted gas flowing out of an automobile or a motorcycle first enters the air intake pipe 101 of the outer pipe 10, then goes through small gaps between the through holes 201 and the galvanized iron strings 30 of the inner hole 20, and, finally gets to the muffling cotton 40, thus, attaining an effect of muffling. However, the aforesaid galvanized iron strings used in the conventional exhaust pipe usually give rise to the following defects.

1. In the process of manufacturing, the galvanized iron strings 30 have to be wound around the inner pipe 20 slowly and smoothly, taking much time and labor.

2. When the galvanized iron strings 30 are wound around the inner pipe 20, small gaps among them have to be preset in order to let exhausted gas easily get to the muffling cotton 40. But, actually, the galvanized iron strings 30 can hardly be wound very smoothly and accurately, causing the small gaps left too few or too small, exhausted gas fails to get to the muffling cotton 40, thus lowering muffling effect.

3. After used for a period of time, the galvanized iron wires 30 are possible to become loosened and pushed backward due to a flowing force of a great amount of exhausted gas.
4. After used for a long time, the galvanized iron wires 30 are liable to be burnt out by the high temperature of exhausted gas.
5. The galvanized iron strings are likely to fall off after used for long.
6. Some exhausted oil gas occasionally flowing out of an automobile or a motorcycle mostly flows out through the inner pipe 20 because the small gaps between the galvanized iron strings 30 of the inner pipe 20 are too few and too small, polluting the environment.

SUMMARY OF THE INVENTION

This invention has been devised to offer an exhaust pipe for an automobile or a motorcycle, including an outer pipe fixedly fitted with an inner pipe inside. An air intake pipe and an air outlet pipes with a comparatively small diameter of the outer pipe are respectively provided to communicate with the front and the rear end of the inner pipe. Further, the inner pipe has a great many through holes bored around its pipe wall and the outer pipe has muffling cotton filled inside.

The feature of the invention is an intermediate pipe fitted around the inner pipe and having a great number of through holes around pipe wall, with a fixed gap formed between the inner and the intermediate pipes and a muffling cotton filled in between them. Such a design is easy to assemble, capable to keep firm and achieve good effect of muffling.

BRIEF DESCRIPTION OF DRAWINGS

This invention will be better understood by referring to the accompanying drawings, wherein.

DETAILED DESCRIPTION OF THE PREFERRED EMBODIMENTS

Figure 1:
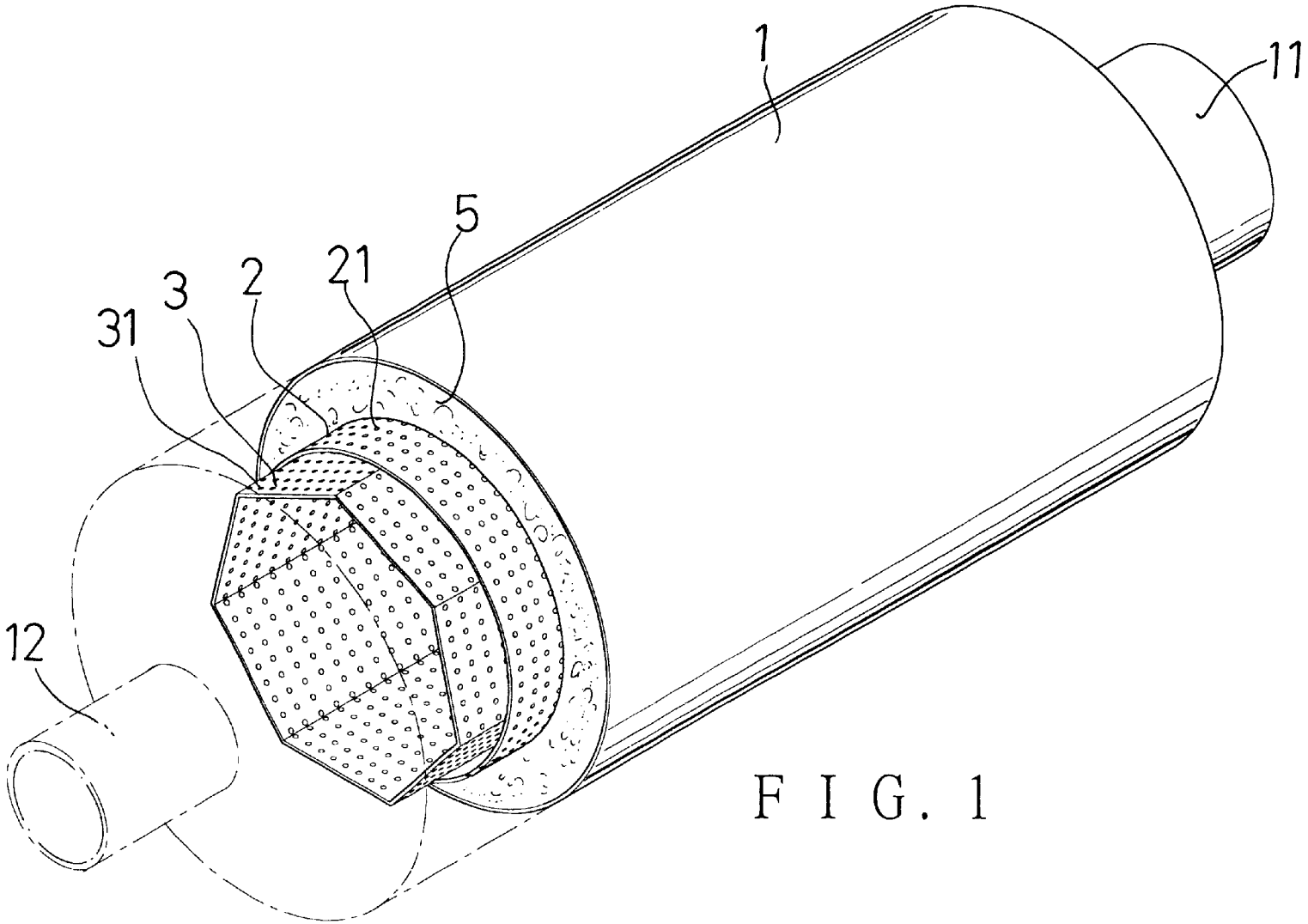
FIG. 1 is a perspective view of a first embodiment of an exhaust pipe for an automobile or a motorcycle of the present invention.
Figure 2:
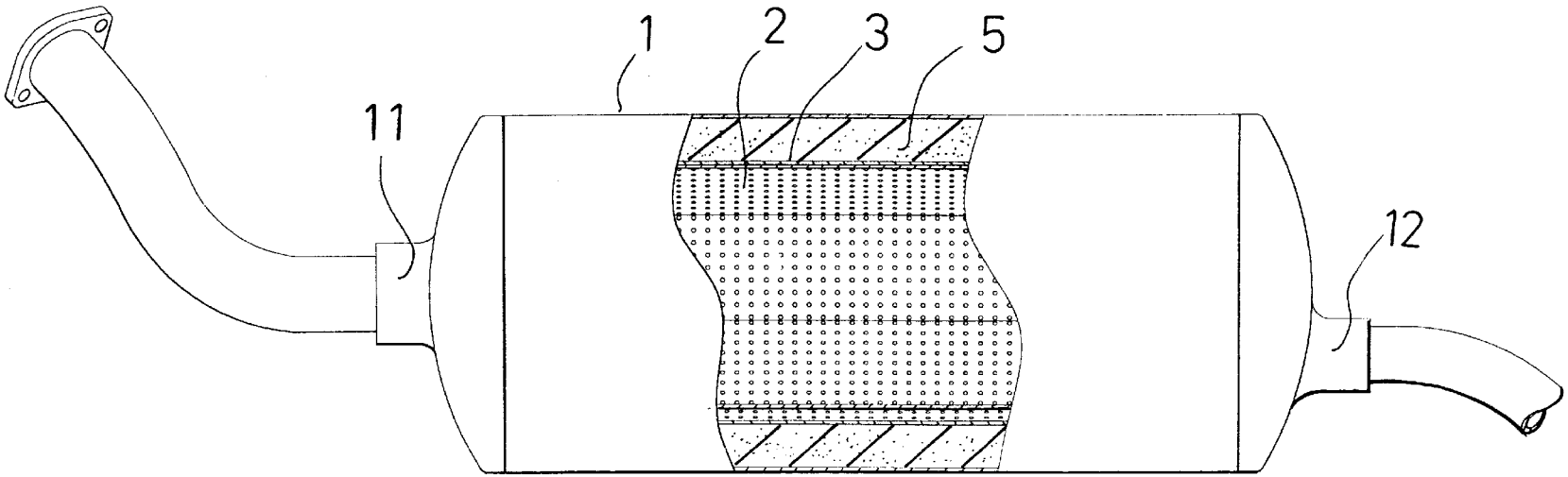
FIG. 2 is a cross-sectional view of the first embodiment of the exhaust pipe for an automobile or a motorcycle of the present invention.
Figure 3:
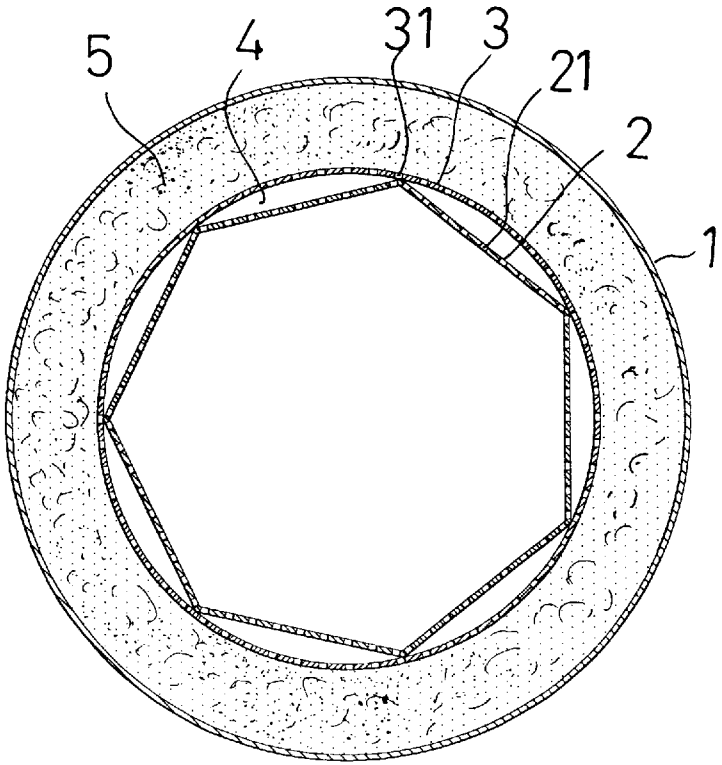
FIG. 3 is a side cross-sectional view of the first embodiment of the exhaust pipe for an automobile or a motorcycle of the present invention.

A preferred embodiment of an exhaust pipe for an automobile or a motorcycle in the present invention, as shown in FIGS. 1, 2 and 3, includes an outer pipe 1 and an inner pipe 2 fitted firmly in the outer pipe 1. An air intake pipe 11 and an air outlet pipe 12 are further provided, having a comparatively small diameter and positioned on two opposite ends of the outer pipe 1 and respectively communicating with the front and the rear end of the inner pipe 2. Besides, an intermediate pipe 3 is provided to fit around the inner pipe 2, with the front ends and the rear ends of the inner and the intermediate pipes 2 and 3 contacting the inner walls of the front end and the rear end of the outer pipe 1. Then, numerous through holes 21 and 31 are bored around the walls of both the inner and the intermediate pipes 2 and 3, and a plurality of gaps 4 are formed between the inner pipe 2 and the intermediate pipes 3, and further a muffling cotton 5 is filled in a space between the outer pipe 1 and the intermediate pipe 3.

Figure 4:
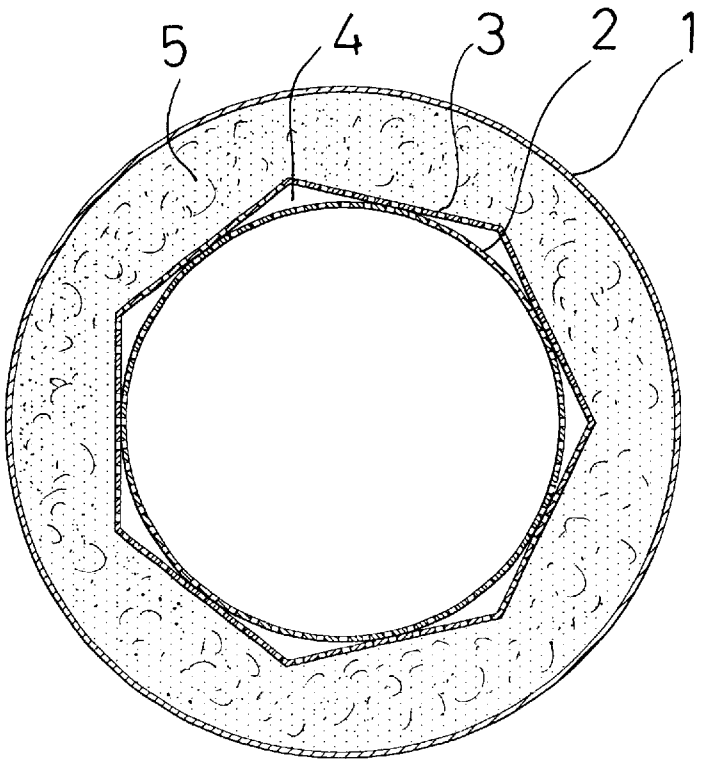
FIG. 4 is a side cross-sectional view of a second embodiment of the exhaust pipe of the present invention.
Figure 6:
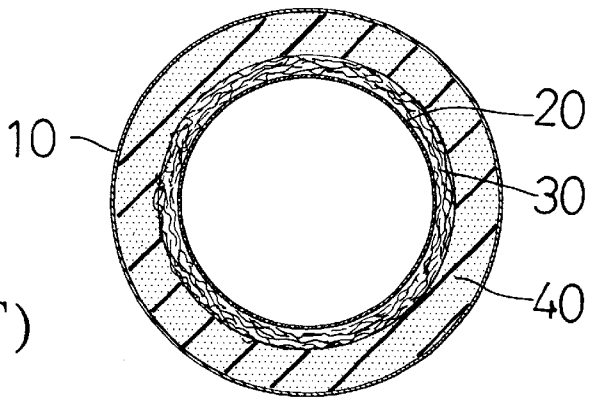
FIG. 6 (PRIOR ART)
FIG. 6 is a side cross-sectional view of the conventional exhaust pipe.
Figure 5:
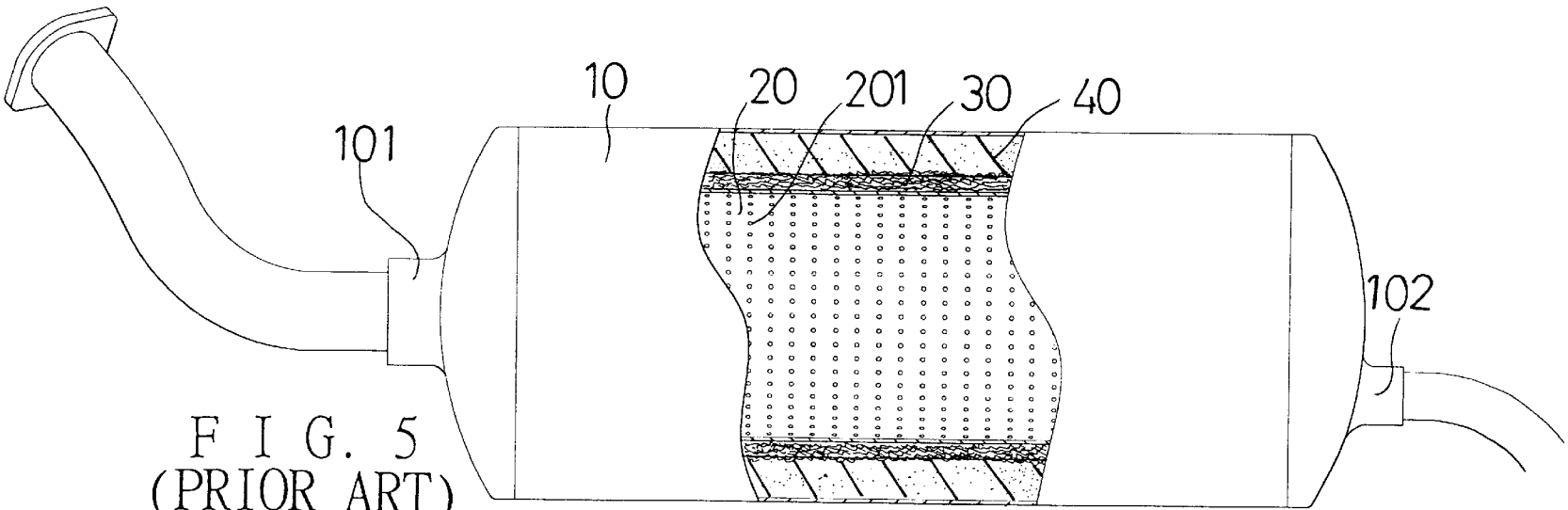
FIG. 5 (PRIOR ART)
FIG. 5 is a lengthwise cross-sectional view of a conventional exhaust pipe.

In addition, either of the inner pipe 2 or the intermediate pipe 3 can be shaped round, and the other shaped polygonal, as shown in FIGS. 3 and 4. Thus, after the inner pipe 2 is fitted in the intermediate pipe 3, only parts of them contact each other and the other non-contact parts form a plurality of gaps 4.

In using, exhausted gas flowing out of an automobile or a motorcycle first enters the air intake pipe 11, then go through the through holes 21 of the inner pipe 2 and the gaps 4, and pass through the through holes 31 of the intermediate pipe 3 to get to the muffling cotton 4, accordingly obtaining effectual muffling.

As can be noted from the above description, this invention has several advantages described below.

1. Either of the inner pipe 2 or the intermediate pipe 3 is shaped round and the other shaped polygonal. Therefore, after the inner pipe 2 is fitted in the intermediate pipe 3, parts of them contact each other in a stabilized condition, facilitating assembling and economizing time and labor in assemblage.
2. The through holes 31 of the intermediate pipe 3 enable exhausted gas get to the muffling cotton 40 smoothly, maintaining a practical effect of muffling.
3. The gaps 4 formed between the inner pipe 2 and the intermediate pipe 3 has an effect of preventing heat.
4. The intermediate pipe 3 and the inner pipe 2 are stably fitted together and have their front and rear ends respectively resting against the two opposite end inner walls of the front and the rear sides of the outer pipe 1 so that the intermediate pipe 3 is firmly secured immovable at all under any circumstances.

5. The intermediate pipe 3 will never loosen and fall off even if it has been used for a long period of time.
6. The high temperature of exhausted gas may not burn out the intermediate pipe 3 even if used for a long time.
7. Some exhausted oil gas occasionally flowing out of an automobile or a motorcycle first enters the inner pipe 2 and then passes through the through holes 21, 31 of the inner and the intermediate pipes 2 and 3 and finally get to the muffling cotton and absorbed, thus not polluting the environment.

What is claimed is:

1. An exhaust pipe for an automobile or a motorcycle comprising:

an outer pipe and an inner pipe fixedly fitted in said outer tube, an air intake pipe fixed at a front end of said outer pipe, an outlet pipe fixed at a rear end of said outer pipe, both said air intake pipe and said outlet pipe having a comparatively small diameter and communicating with the front and the rear end of said inner pipe, said inner pipe bored with a plurality of through holes around its wall; and, characterized by an intermediate pipe fitted around said inner pipe, said intermediate pipe bored with numerous through holes around its wall, a plurality of gaps formed between said inner pipe and said intermediate pipe, muffling cotton filled in a space between said outer pipe and said intermediate pipe;

wherein said inner pipe is round-shaped and said intermediate pipe is polygon-shaped so that after said inner pipe is fitted in said intermediate pipe, parts of said inner pipe and of said intermediate pipe contact each other stably and non-contact parts of both the pipes form a plurality of gaps;

whereby said intermediate pipe is assembled easily and securely retained for muffling exhaust noise.

2. An exhaust pipe assembly for muffling exhaust noise of a vehicle comprising:

(a) an outer pipe having air inlet and air outlet pipes extending axially therefrom, said outer pipe defining an inner space;

(b) an axially extended intermediate pipe disposed within said inner space of said outer pipe, said intermediate pipe including a first sidewall portion having a plurality of through holes formed therein;

(c) a muffling cotton layer disposed between said first sidewall portion of said intermediate pipe and said outer pipe; and, (d) an axially extended inner pipe coaxially disposed within said intermediate pipe, said inner pipe including a second sidewall portion having a plurality of through holes formed therein;

one of said inner and intermediate pipes having a substantially round sectional contour, and the other of said inner and intermediate pipes having a polygonal sectional contour;

said first and second sidewall portions maintaining axially extended contact to define therebetween a plurality of axially extending gaps angularly displaced one from the other.

3. The exhaust pipe assembly as recited in claim 2 wherein said first sidewall portion of said intermediate pipe is polygonal in sectional contour, and said second sidewall portion of said inner pipe is substantially round in sectional contour; said second sidewall portion maintaining axially extended frictional engagement with said first sidewall portion.

4. The exhaust pipe assembly as recited in claim 2 wherein said first sidewall portion of said intermediate pipe is substantially round in sectional contour, and said second sidewall portion of said inner pipe is polygonal in sectional contour; said second sidewall portion maintaining axially extended frictional engagement with said first sidewall portion.

* * * * *